US005547162A

United States Patent [19]

Sobolewski et al.

[11] Patent Number: 5,547,162

[45] Date of Patent: Aug. 20, 1996

[54] ARCHERY BOW STAND

[76] Inventors: Eugene R. Sobolewski, R.D. 1, Box 1008, Barnesville, Pa. 18214; David M. Roskos, 545 E. Muir Ave., Hazleton, Pa. 18201

[21] Appl. No.: 332,261

[22] Filed: Oct. 31, 1994

[51] Int. Cl.[6] ..... F41B 5/00

[52] U.S. Cl. ..... 248/688; 124/88; 124/89; 248/166

[58] Field of Search ..... 248/166, 170, 248/176, 309.1, 351, 682, 685, 688; 124/23.1, 86, 88, 89

[56] References Cited

U.S. PATENT DOCUMENTS

| | | | |
|---|---|---|---|
| 714,043 | 11/1902 | Seitz | 248/170 |
| 988,912 | 4/1911 | Tompkins | 248/170 X |
| 1,226,554 | 5/1917 | Mante | 248/170 X |
| 3,256,872 | 6/1966 | Koser | 124/23.1 |
| 4,360,179 | 11/1982 | Roberts | 124/23.1 X |
| 4,846,140 | 7/1989 | DiMartino | 124/86 X |
| 4,993,398 | 2/1991 | Wallace | 124/23.1 |
| 5,106,044 | 4/1992 | Regard, III et al. | 124/23.1 X |
| 5,197,701 | 3/1993 | Olson | 248/166 |
| 5,205,272 | 4/1993 | Boyer | 124/88 X |
| 5,222,705 | 6/1993 | Gibran et al. | 248/170 |

*Primary Examiner*—Alvin C. Chin-Shue
*Assistant Examiner*—Derek J. Berger
*Attorney, Agent, or Firm*—Cushman Darby & Cushman, L.L.P.

[57] ABSTRACT

The present invention reveals a screw-on device that attaches to an archery bow and enables the bow to stand in a vertical position in relation to the ground. The archery bow stand attaches to a standard bushing on an archery bow and is made of an elongated body with a retractable leg. The retractable leg is positioned in a groove along the elongated body and is connected to the body by a spring pin. By extending the retractable leg of the bow stand, a bow can be placed in a free standing vertical position.

5 Claims, 4 Drawing Sheets

ARCHERY BOW STAND

BACKGROUND OF THE INVENTION

1. Field of the Invention

The present invention relates to a screw-on device that attaches to an archery bow and allows the archery bow to stand in a vertical position in relation to the ground. The screw-on device is termed an archery bow stand, attaches to a standard bushing on an archery bow and contains a retractable leg that enables the bow to become free standing.

2. Description of the Related Art

After shooting arrows at a target or at three-dimensional shoots, an archer generally lays his bow on the ground on its side, i.e., in a horizontal position in relation to the ground, in order to free his hands. When the bow is placed on the ground in the horizontal position, a situation exists for damage to occur to the strings, cables, cams, sights, body and painted finish of the bow. The bow is usually placed on the ground among dirt, rocks, leaves or high grass.

Damage to the bow can occur in numerous ways. For example, particles of grass or dirt can enter into the cam mechanism and bearings of the bow. The sights of the bow can be knocked out of alignment by bumping or jarring when placed on the ground. The bow can be stepped or tramped upon when placed in the horizontal position. The bow is also more easily lost when placed on the ground, especially in the woods and in high grass. In addition, an archer increases his risk of back injury and muscle strain when he bends in order to pick up his bow from the ground.

To our knowledge, the only device available to archers to prevent the above-mentioned damage to the bow and to reduce the risk of back injury to an archer is a permanent or stationary bow stand. Such a stand is nothing more than a table that allows the archer to place his bow in an elevated position, i.e., three feet above the ground. The bow is placed in a horizontal position on the bow stand table. The stationary stand, as the name implies, is usually kept in one place and is not easily moved from one position to another. Thus, the stationary stand has limited utility for target shooters and even less for hunters.

We have invented a device that enables a bow to stand in a vertical position and thereby overcome the above-mentioned problems. The device is mobile, compact, easily attached to a bow and conveniently transported in the archer's bow case.

SUMMARY OF THE INVENTION

The present invention discloses a screw-on device that attaches to an archery bow and allows the archery bow to stand in a vertical position in relation to the ground. The screw-on device is termed an archery bow stand, attaches to a standard bushing on an archery bow and contains a retractable leg that enables the bow to become free standing.

The archery bow stand is comprised of a elongated body with a retractable leg. The retractable leg is positioned in a keyway or groove along the elongated body and is pivotably connected to the elongated body. In addition, the elongated body contains a stud at one end for attachment to the bow. By extending the retractable leg of the bow stand, a bow can be placed in a free standing vertical position.

More specifically, the archery bow stand is comprised of an elongated body having a free end and an opposite end and a retractable leg having a free end and an opposite end. The free end of the retractable leg extends beyond the free end of the elongated body and the opposite end of the retractable leg is pivotably connected to the elongated body by a spring pin.

Furthermore, the elongated body has an inset at its opposite end and a keyway between the free end and the opposite end. The retractable leg is snap fitted within the keyway of the elongated body and a threaded stud is connected to the elongated body at the inset at the opposite end of the elongated body.

DETAILED DESCRIPTION OF THE INVENTION

A standard archery bow is comprised of a main body having a central riser, limbs connected to each end of the riser and archery string connecting the limbs. The riser usually contains a hand grip just below the mid-point of the riser and a standard bushing just below the hand grip. The bushing is usually a 5/16–24 threaded bushing. The standard bushing is also called a stabilizer bushing and is used for mounting a stabilizer, fishing line and reel, tracking string, or any other device or attachment.

Figure 1:
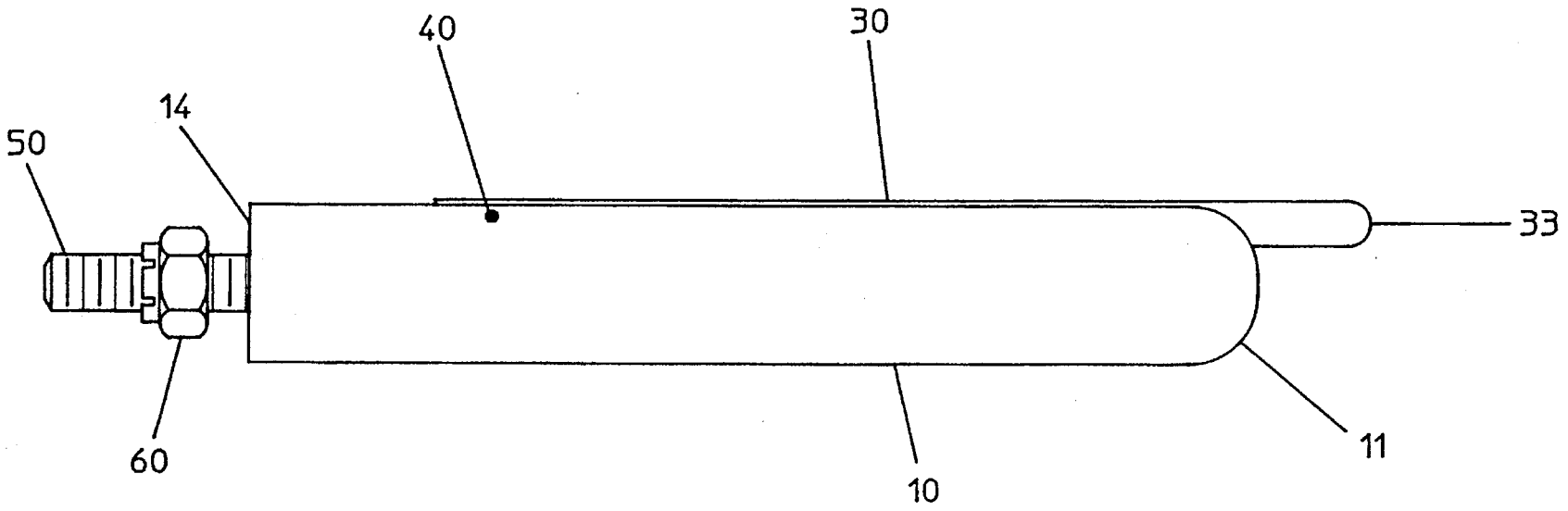
FIG. 1 shows a side view of the archery bow stand of the present invention. An elongated body 10 is connected to a retractable leg 30 by a spring pin 40. The retractable leg 30 is shown in a retracted position. The elongated body 10 contains a stud 50 at one end for attachment to the bow. The stud 50 is shown with a self locking nut 60.

The present invention is for an archery bow stand that can be connected to the standard bushing on an archery bow. The archery bow stand as shown in FIG. 1 is comprised of a elongated body 10 with a retractable leg 30. The retractable leg 30 is pivotably connected to the elongated body 10 by a spring pin 40. In FIG. 1, the retractable leg 30 is aligned with or parallel with the elongated body 10. The retractable leg 30 is shown in a retracted position.

In addition, the elongated body 10 contains a stud 50 at one end for attachment to the bow. The stud 50 is shown with a self locking nut 60. By extending the retractable leg 30 of the bow stand as shown in FIG. 2, a bow can be placed in a free standing vertical position.

The elongated body 10 contains a keyway or groove 20 (FIGS. 5 and 6) along its length. The retractable leg 30 is connected to the elongated body 10 by a spring pin 40. The elongated body 10 contains a stud 50 at one end for attachment to the bow.

FIG. 1 also shows the relationship of the retractable leg 30 with the keyway or groove 20 (FIGS. 5 and 6) of the elongated body 10. The retractable leg 30 snap fits or locks into the keyway or groove 20. When the retractable leg 30 is snap fitted or locked within the elongated body 10, the retractable leg 30 is in a retracted position. In the retracted position, the retractable leg 30 is aligned with the elongated body 10 and the free or distal end 33 of the retractable leg 30 extends a distance beyond the free or distal end 11 of the elongated body 10. This distance should be at least one-twentieth or 0.05 times the distance from the free or distal end 11 to the opposite or proximal end 14 of the elongated body 10. Preferably, this distance is between 0.05 to 0.20 times the distance from the free end 11 to the opposite end 14 of the elongated body 10. The distance from the free end 11 to the opposite end 14 of the elongated body 10 is referred to as the elongated body length.

Figure 2:
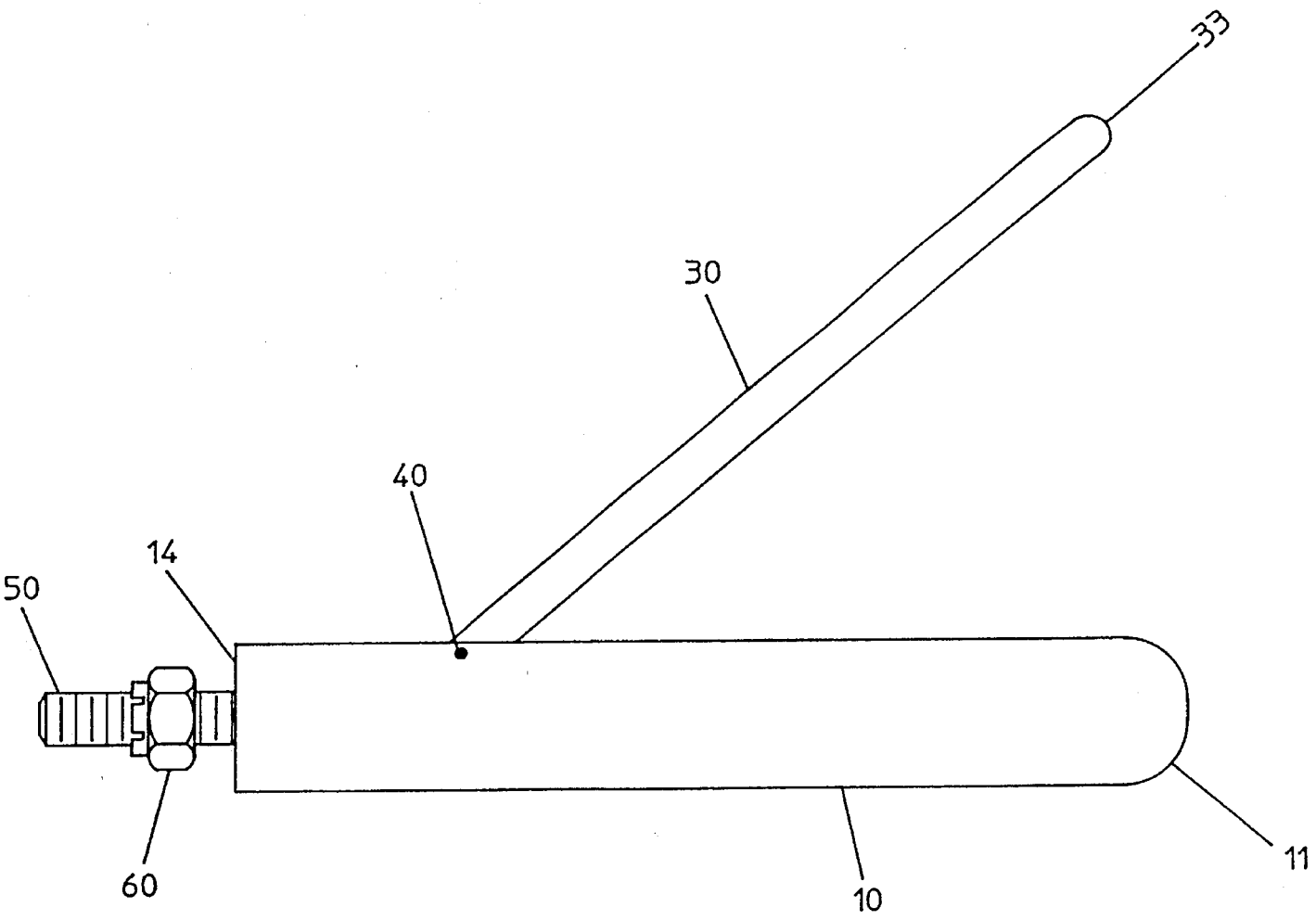
FIG. 2 shows a side view of the archery bow stand with the retractable leg 30 in an extended position.

The extension of the free or distal end 33 of the retractable leg 30 beyond the free or distal end 11 of the elongated body 10 allows the stand to function in holding the bow in a vertical position when the bow stand is used by extending the retractable leg 30 from the elongated body 10 (FIG. 2).

Figure 3:
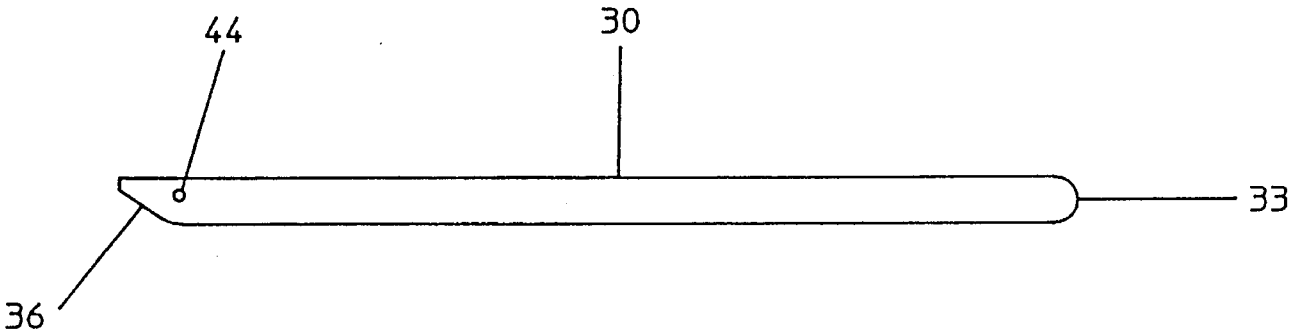
FIG. 3 is a view of the retractable leg 30 in isolation.

FIG. 3 shows the retractable leg 30 in isolation. The free end 33 of the retractable leg 30 is that part which extends beyond the elongated body 10 when the retractable leg 30 is snap fitted or locked within the keyway or groove 20 of the elongated body 10. A hole or through or thru 44 at the opposite or proximal end 36 of the retractable leg 30 indicates the place where the spring pin 40 is inserted in order to pivotably attach or connect the retractable leg 30 to the elongated body 10.

The retractable leg 30 can be made of any hard material of sufficient strength to support the weight of the bow. Thus, the retractable leg 30 may be made of metal, wood or plastic including aluminum, steel, brass, copper, titanium, graphite, maple, oak, pine, walnut, fiberglass, polyethylene, polypropylene or polyurethane. The retractable leg 30 is preferably made of aluminum.

Figure 4:
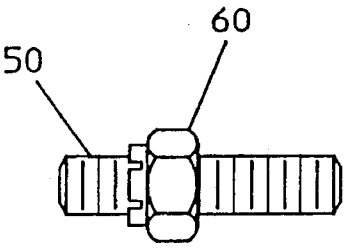
FIG. 4 is a view of the stud 50 and self locking nut 60 in isolation.

FIG. 4 is a view of the stud 50 and self locking nut 60 in isolation. The stud 50 is attached to the opposite or proximal end 14 of the elongated body 10 by insertion into a central inset 70. The stud 50 contains a self locking nut 60 which can be used to index or position the archery bow stand for right or left handed shooters or to adjust the stand in various degrees in the vertical position.

The stud 50 is usually a 5/16–24 threaded stud which can be threadably attached or connected to the stabilizer bushing on a bow. The stud 50 can be made of any hard material capable of holding a thread. Thus, the stud 50 may be made of metal, wood or plastic including aluminum, steel, brass, copper, titanium, graphite, maple, oak, pine, walnut, fiberglass, polyethylene, polypropylene or polyurethane. The stud 50 is preferably made of steel.

Figure 5:
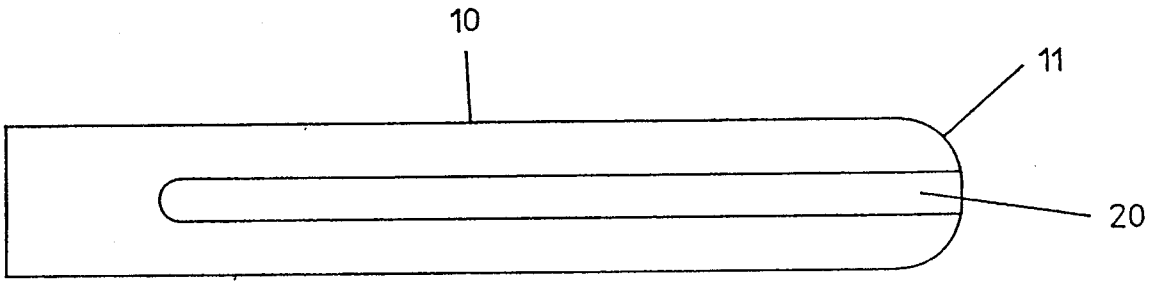
FIG. 5 is a top view of the elongated body 10 in isolation showing the position of the keyway or groove 20 along its length.

FIGS. 5 is a top view of the elongated body 10 in isolation showing the position of the keyway or groove 20 along its length. The free or distal end 11 of the elongated body 10 is that end which comes in contact with the ground when the bow stand is used to hold a bow in the vertical position.

Figure 6:
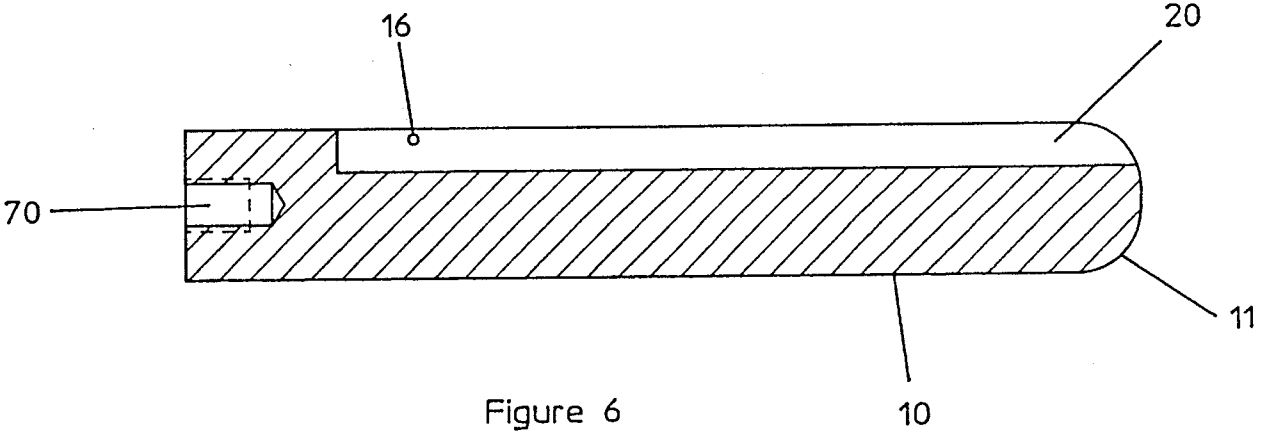
FIG. 6 is a cross-sectional view of the elongated body 10, showing the position of the keyway or groove 20 along its length and the inset 70 for attachment of the stud 50 to the elongated body 10.

FIG. 6 is a cross-sectional view of the elongated body 10 showing a hole or through or thru 16 to indicate the place where the spring pin 40 is inserted in order to attach or connect the retractable leg 30 to the elongated body 10. The holes or thrus 16 of the elongated body be 10 are aligned with the hole or thru 44 (FIG. 3) of the retractable leg 30.

FIG. 6 also shows the inset 70 at the opposite or proximal end 14 of the elongated body where the stud 50 (FIG. 4) can be threadably attached to the elongated body 10.

The elongated body 10 can be made of any hard material of sufficient strength to support the weight of the bow. Thus, the elongated body 10 can be made of metal, wood or plastic including aluminum, steel, brass, copper, titanium, graphite, maple, oak, pine, walnut, fiberglass, polyethylene, polypropylene or polyurethane. The elongated body 10 is preferably made of aluminum.

In a preferred embodiment, the elongated body length is 5½ inches, the length of the keyway is 4⅝ inches, the length of the retractable leg is 5⅛ inches and the diameter, width or thickness of the elongated body is ⅞ of an inch. Thus, the retractable leg extends a distance of approximately ½ of an inch beyond the free end of the elongated body when the retractable leg is in the retracted distance. The distance of ½ inch is 0.091 times the elongated body length (½/5½).

In another preferred embodiment, the elongated body length is 6½ inches, the length of the keyway is 5⅝ inches, the length of the retractable leg is 6⅛ inches and the diameter, width or thickness of the elongated body is ⅞ of an inch. Thus, the retractable leg extends a distance of approximately ½ of an inch beyond the free end of the elongated body when the retractable leg is in the retracted position. The distance of ½ inch is 0.077 times the elongated body length (½/6½).

In another preferred embodiment, the elongated body length is 7½ inches, the length of the keyway is 6⅝ inches, the length of the retractable leg is 7⅛ inches and the diameter, width or thickness of the elongated body is ⅞ of an inch. Thus, the retractable leg extends a distance of approximately ½ of an inch beyond the free end of the elongated body when the retractable leg is in the retracted position. The distance of ½ inch is 0.067 times the elongated body length (½/7½).

As mentioned above, the archery bow stand of the present invention can be attached to the standard bushing on any bow. To operate the archery bow stand, the archer simply extends the retractable leg 30 from the snap fitted or locked position and places the bow in the vertical position on the ground or on any flat surface. The bow then stand by itself in the vertical position.

The archery bow stand of the present invention also functions as a stabilizer for the bow. The archery bow stand is connected to the bow at the same position that a standard stabilizer is attached to a bow, i.e., at the standard bushing or stabilizer bushing. Thus, the size and composition of the archery bow stand can be adjusted or varied in order to conform to the desired weight for a given stabilizer. For example, if the archery bow stand is to be used as a light weight stabilizer, the stand can be made of plastic. If a stand is to be used as a heavier weight stabilizer, the stand can be made of metal. If the stand is to be used as an even heavier weight stabilizer, the size of the metal stand can be increased.

By using the bow stand with the bow in the vertical position, almost all damage to the bow is greatly reduced or eliminated. Thus, scratching and other damage to the finish of the bow that can be caused by placing the bow on the ground in a horizontal position is practically eliminated. The possibility of knocking the sights out of adjustment or alignment by placing the bow in a horizontal position is also greatly reduced, if not eliminated by using the present invention.

Likewise, the probability of having dirt, leaves and/or grass enter into the cam mechanisms, bearings, limbs and other moving mechanisms of the bow is greatly reduced by placing the bow in the vertical position with the present invention. Moreover, the possibility of damaging the bow by stepping on it are greatly reduced when the archery bow stand is used to hold the bow in the vertical position.

The present invention also eliminates the need for the archer to bend over in order to lift the bow from the ground. This elimination of the archer's need to bend reduces the archer's risk of back injury or muscle strain and facilitates hunting. The elimination of bending results in limited motion by the archer. Limited motion reduces the archer's chances of being detected by the game or animal that is being hunted.

The present invention also makes a bow more visible than a bow placed on the ground. A bow in the horizontal position on the ground has a height of approximately three inches. The present invention enables a bow to stand in the vertical position. A bow in the vertical position on the ground has a height of between 24 and 32 inches. The increased height increases the visibility of the bow. This increased visibility is made even more important for hunting bows that are painted with camouflage colors.

The present invention can also be used to reduce damage to trees. Hunters sometimes drive nails into trees in order to hang their bows and thereby prevent damage to their bows which might occur if the bows were placed on the ground in the horizontal position. Use of the present invention would thus eliminate the need for the sometimes illegal practice of hammering nails into trees.

Since most archery tournaments do not provide permanent bow stands and since none are available in the woods, the present invention provides the archer with the opportunity to attend and participate in any archery tournament and to hunt in any terrain or area without the risk of bow damage which could occur when the bow is placed on the ground in the horizontal position. Thus, the present invention provides the bow with a bow stand that goes everywhere that the bow goes. The archery bow stand is mobile, compact, easily attached to a bow and conveniently transported in an archer's bow case.

While the invention has been described in connection with what is presently considered to be the most practical and preferred embodiment, it is to be understood that the invention is not limited to the disclosed embodiment, but on the contrary is intended to cover various modifications and equivalent arrangements included within the spirit and scope of the appended claims.

Thus, it is to be understood that variations in the archery bow stand can be made without departing from the novel aspects of this invention as defined in the claims.

What is claimed is:

1. An archery bow stand, comprising:

a) an elongated body having a free end and an opposite end, said free end separated from said opposite end by an elongated body length and b) a retractable leg having a free end and an opposite end, said retractable leg pivotably connected at said opposite end to said elongated body and said retractable leg aligned with said elongated body when said retractable leg is in a retracted position, wherein said free end of said retractable leg extends a distance beyond said free end of said elongated body when said retractable leg is in said retracted position and wherein said distance is at least 0.05 times the elongated body length, wherein said elongated body further comprises an inset at said opposite end of said elongated body and a keyway between said free end and said opposite end of said elongated body, and wherein said retractable leg is snap fitted within said keyway of said elongated body.

2. The archery bow stand of claim 1, further comprising a stud, wherein said stud is connected to said elongated body at said inset at said opposite end of said elongated body.

3. The archery bow stand of claim 2 wherein said stud is threaded.

4. The archery bow stand of claim 1 wherein said elongated body and said retractable leg are made from a substance selected from the group consisting of metal, wood and plastic.

5. The archery bow stand of claim 1, wherein said elongated body and said retractable leg are made of aluminum.

* * * * *